US006223856B1

(12) United States Patent
Schwoerer

(10) Patent No.: US 6,223,856 B1
(45) Date of Patent: May 1, 2001

(54) DISMOUNTABLE SCAFFOLDING WITH BASE PLATES ARRANGED ON CROSS STRUTS

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 09/381,111

(22) PCT Filed: Mar. 18, 1998

(86) PCT No.: PCT/EP98/01587

§ 371 Date: Nov. 24, 1999

§ 102(e) Date: Nov. 24, 1999

(87) PCT Pub. No.: WO98/41712

PCT Pub. Date: Sep. 24, 1998

(30) Foreign Application Priority Data

Mar. 19, 1997 (DE) ..... 197 11 498

(51) Int. Cl.[7] ..... E04G 1/15
(52) U.S. Cl. ..... 182/178.1; 182/222
(58) Field of Search ..... 182/222, 119, 182/178.1

(56) References Cited

U.S. PATENT DOCUMENTS 4,372,424 * 2/1983 Langer ..... 182/186.8

FOREIGN PATENT DOCUMENTS

3020389A1 12/1981 (DE) .
3923815A1 1/1991 (DE) .
4 91 634 * 6/1992 (EP) .

* cited by examiner

*Primary Examiner*—Alvin Chin-Shue
(74) *Attorney, Agent, or Firm*—Townsend and Townsend and Crew LLP

(57) ABSTRACT

The invention relates to a dismountable scaffolding with vertical struts and horizontal struts. A base plate extends between said struts and is provided with hook-shaped end fittings on each front face. Said base plate can be placed on a rail section in such a way that vertical locking or unlocking can be selectably achieved by sliding the end fitting in the direction of the rail section. Horizontal antislip locking is achieved and cancelled by raising the end fitting, thereby preventing said fitting from sliding into an inactive vertical locking position when it is in an active vertical position.

25 Claims, 5 Drawing Sheets

-22-
-21-
VI
VII
P

S

P

-22-
-21-
X
X
IX
IX
R
11
11'
12
13
14
14'
15'
16
17
18
18'
19
20
23
25
26
31

13
14
14'
15
15a
15b
15'a
15'b
16
17
18
19
24

-22-
-21-
11
11'
15
18'
18''
19
23'
24'
R

DISMOUNTABLE SCAFFOLDING WITH BASE PLATES ARRANGED ON CROSS STRUTS

BACKGROUND OF THE INVENTION

The invention relates to a dismantlable scaffold and in particular to a facade scaffold in.

In a known scaffold of this lind (DE196 33 091 A1), latching catches are provided at the end fittings of the individual floor panels and ensure latching of the end fittings on placement of a floor panel on the associated rail section, so that a lifting of the end fittings from the associated rail section is only possible after pivoting of the latching catch into a release position. A design of this kind admittedly ensures that a floor panel is securely held against lifting on the rail section, even without a transverse strut which contacts against its end fittings from above; it is, however, disadvantageous that for this purpose a movable element in the form of a latching catch must be present which has to be actuated by suitable measures by the operator for the lifting and which can be damaged with rough operation on a building site and thereby made partly or wholly inactive.

SUMMARY OF THE INVENTION

It is therefore an object of the present invention to provide a scaffold of the initially named kind in which, on the one hand, the floor panels can be installed on the rail sections and removed from them without problem without the use of movable elements on the rail section and end fitting, and, on the other hand, in the installed position undesired lifting, for example by winding or other lifting forces acting from below, is however avoided, without the end fittings having to be secured by transverse struts of the scaffold lying above them.

The concept underlying the invention is thus to be seen in the fact that simply by a sequence of suitable shifts of a floor panel in the horizontal and vertical direction, a simple installation and removal of the floor panels is, on the one hand, possible with respect to the associated rail sections, and, on the other hand, the floor panels are secured against lifting up-wardly by wind or other forces in the installed state. The lifting of the floor panel required to cancel the security against shifting preferably takes place at one side and indeed in particular at the front.

The security against lifting and/or the security against shifting are preferably formed by abutments.

The depth of insertion of each floor panel is advantageously restricted with the insertion restriction when using a plurality of floor panels arranged behind one another preferably being ensured for the last floor panel by the vertical supports and for the floor panels lying in front of it by the respective rearwardly disposed floor panel.

The security against lifting is expediently realized with a linearly operating bayonet connection between the end fitting and the associated rail section.

An abutment serving for the positioning is also provided in the pull-out direction, at least for the frontmost floor panel, so that on pulling out the floor panel, the position in which the lifting security is cancelled is found without particular attention on behalf of the operator. This abutment is preferably formed by the forwardly disposed vertical supports.

An embodiment of the invention brings the shifting security abutments out of engagement while the lifting security abutments are still active.

Even though it is fundamentally possible for the different abutments to be provided on the same side of the rail section, it is, however, preferred when these abutments are arranged so that the shifting security abutments can be comfortably executed between the rail sections as plates which preferably consist of sheet metal.

Even though a single floor panel can basically be provided between two vertical supports and designed in accordance with the invention, it is, nevertheless, advantageous, to preferably provide two or more floor panels of like design behind one another, because in this way an easier manipulation is possible at greater heights because of the lower weight of the individual floor panel.

Insofar as a plurality of floor panels are provided behind one another, the shifting security abutments of the rear floor panels can be expediently designed differently from those of the front floor panel.

Thus, whereas the shifting security abutments of the front floor panel are so positioned relative to one another that a lifting of the front floor panel is still not possible when they come into engagement, the abutment plates of the rail sections which lie further to the rear are so arranged that on entry into engagement with the positioning abutments of the end fittings, the security against lifting has already been cancelled. This design is possible and expedient because, as long as the front floor panel has not yet been removed, the floor panels lying further to the rear are secured by the same measures as the front floor panel against shifting towards the insertion side into a position which makes lifting possible.

A particularly advantageous further embodiment signals to the operator on inserting the floor panels particularly forcefully, whether these are already latched in place or not. So long as the shifting security abutments are located on the shifting security abutment plates between the rail sections, the floor panel tilts during handling to the front and to the rear so that the operator gets a feeling for the fact that the relevant panel is not yet in its desired position. Only when the shifting security abutment of the end fitting of the abutment plate drops rearwardly into the lowered position does the tilting cease and signal to the user that the floor panel is now located in its final desired position. With a plurality of floor panels arranged behind one another, it is sufficient if only the frontmost shifting security abutment plate is correspondingly designed.

Another embodiment of the invention ensures that the floor panels can also extend up to the region adjacent the vertical supports, so that broad walking surface is present. The design of the invention proves to be particularly expedient here, because it results in a certain overhang of the floor panels beyond the support surfaces on the rail sections, which, when walked on, exert a tilting moment on the floor panels about their longitudinal axis in the sense that they attempt to lift from the rail sections. This is, however, effectively avoided by the security against lifting provided in accordance with the invention so that the over-hang of the floor panels to the front and rear beyond the rail sections does not represent any deterioration of the security in use.

A further embodiment of the invention provide that the opening in the region of the end cutouts, which is present with two floor panels contacting one another, is secured downwardly by the positioning plate, which has the advantage that articles falling through this opening are stopped by the abutment plate.

Another embodiment of the invention makes it possible for the security against lifting to be cancelled by pivoting the floor panel downwardly about one of the rail sections, whereby the relevant floor panel can be lifted off without shifting in the direction of the rail section but rather by simple downward pivoting. In the inverse sense the placement of a floor panel on the rail section is also possible. The pivoting downwardly or upwardly of the floor panels can be made possible by elastic pressing apart of two adjacent vertical support pairs.

A further feature of the invention provides a situation in which a maximum support surface is made available between the end fittings and the associated rail sections.

The present inventor facilitates the placement of a floor panel obliquely from below onto a transverse strut in that the shifting security abutment forms a stop with the rail section, which is to be correspondingly dimensioned, and prevents a shifting of the end fitting beyond the transverse strut and thus prevents a dropping down of the relevant end of the floor panel.

DESCRIPTION OF THE PREFERRED EMBODIMENTS

Figure 1:
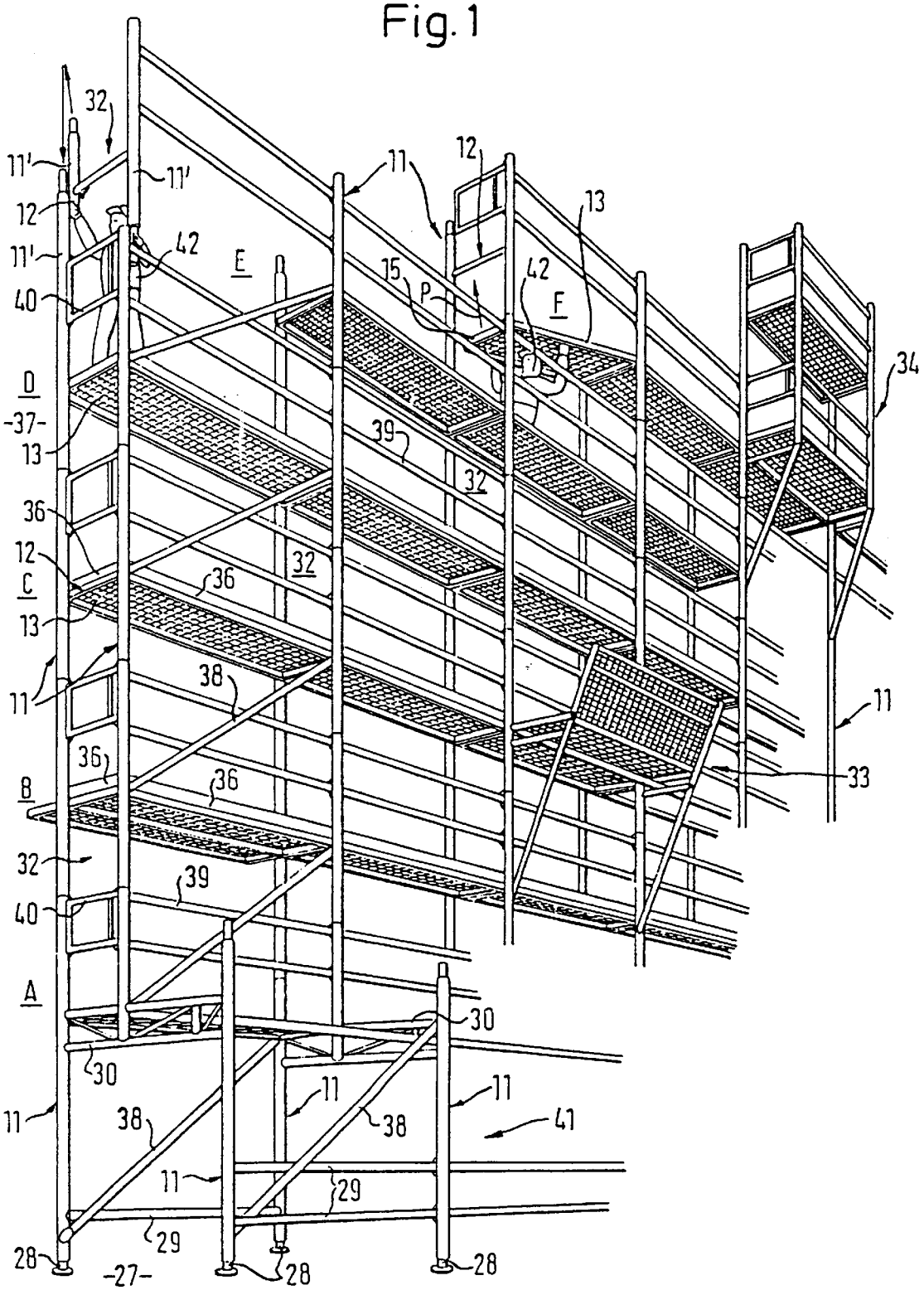
FIG. 1 is a schematic perspective view of a facade scaffold being assembled in which the invention can be used.

The same reference numerals designate corresponding components in all Figures.

In accordance with FIG. 1 a facade scaffold is being assembled at a building construction 37, On the ground 27 four vertical supports 11 are supported via vertically adjustable spindle arrangements 28 in an arrangement with a rectangular base area, the longer side of which extends parallel to the front of the building construction 37, and are completed by transverse beams 30 provided above head height, longitudinal supports 29 and also diagonal struts 38 to a supporting base framework 41, which is continued in a suitable manner at the bottom right in FIG. 1, which is not shown in detail. The base framework 41 has no transverse struts in its lower region, i.e. beneath head height, so that a passage can be provided there, for example for pedestrians.

Whereas the rear vertical supports 11 continue upwardly, the front vertical supports 11 are offset to the rear above the transverse beams 30, so that the spacing between the front and rear vertical supports 11 is more than halved. The vertical supports 11 arranged behind one another, which consist of plugged-together individual elements 11', form, together with horizontal transverse struts 12 extending between them at a vertical spacing, end frames 32, which, as one can recognize from the top left in FIG. 1, are asymmetrically designed and can be plugged together. In this manner numerous end frames 32 are so plugged together, optionally with the intermediary of individual elements 11' not connected by transverse struts 12, so that in each case one transverse strut 12 is present per vertical support pair at the vertical spacing of the stories A, B, C, D, E and F that are provided. A total of seven end frame arrangements consisting of end frames 32 assembled vertically above one another, each having a number of transverse struts 12 lying at the same height, are provided along the building construction 37 at uniform intervals.

The narrow sides of rectangular floor panels 13 each provided with end fittings 15 are releasably placed, in the manner which will be described in detail with reference to FIGS. 2 to 11, on two transverse struts 12 arranged alongside one another in front of the building construction 37.

The facade scaffold has, furthermore, two forwardly projecting auxiliary scaffolds 33 and 34 respectively.

The front vertical supports 11 at the comers of the base frame 41 can be used at the top for the mounting of suitable further support elements. For the security of persons working on the floor panels 13, railings 39, 40 are secured to the vertical supports 11 at a suitable height at the side and also at the end faces.

Curb strips 36 are releasably secured at the bottom, in particular at the side of the floor panels 13 remote from the building construction 37, and also if required at the side adjacent the building construction 37 and at the end faces, preferably to the transverse struts 12. The curb strips 36 are intended to prevent tools lying on the floor panels being pushed sideways beyond the floor panels 13 when walked upon and being able to fall down from the facade scaffold.

In accordance with FIG. 1 the stories A, B, C, D are already finished, whereas the stories E, F are being assembled.

Figure 2:
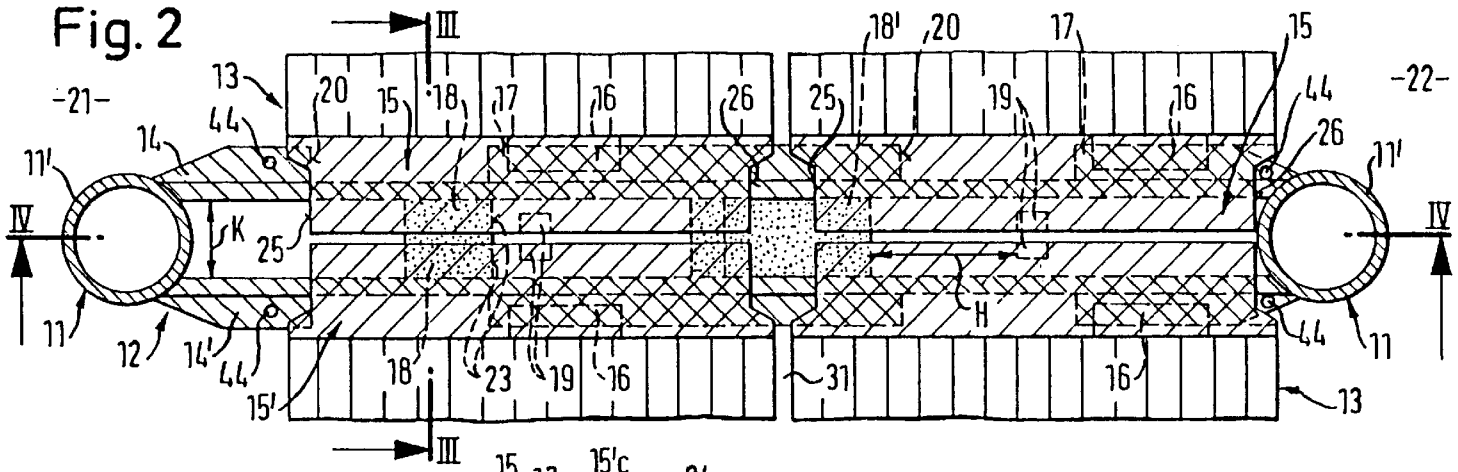
FIG. 2 is a partly sectioned schematic plan view of a scaffold in accordance with the invention in the region of the arrangement of floor panels on a transverse strut provided between two vertical supports.
Figure 3:
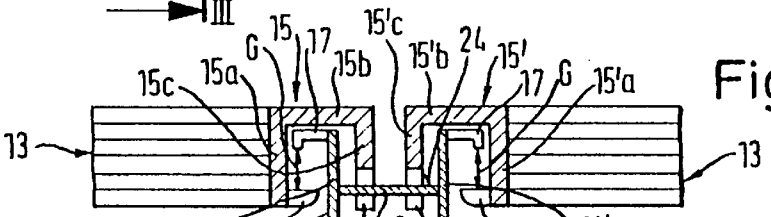
FIG. 3 is a schematic sectional view in accordance with the line III—III in FIG. 2.
Figure 4:
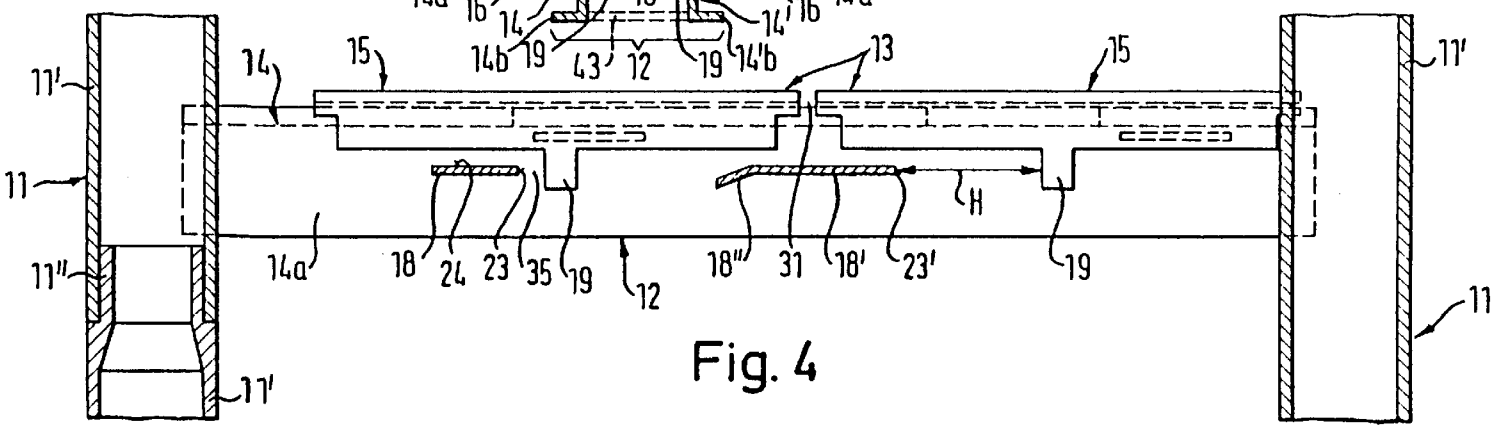
FIG. 4 is a schematic sectional view in accordance with the line IV—IV in FIG. 2.
Figure 5:
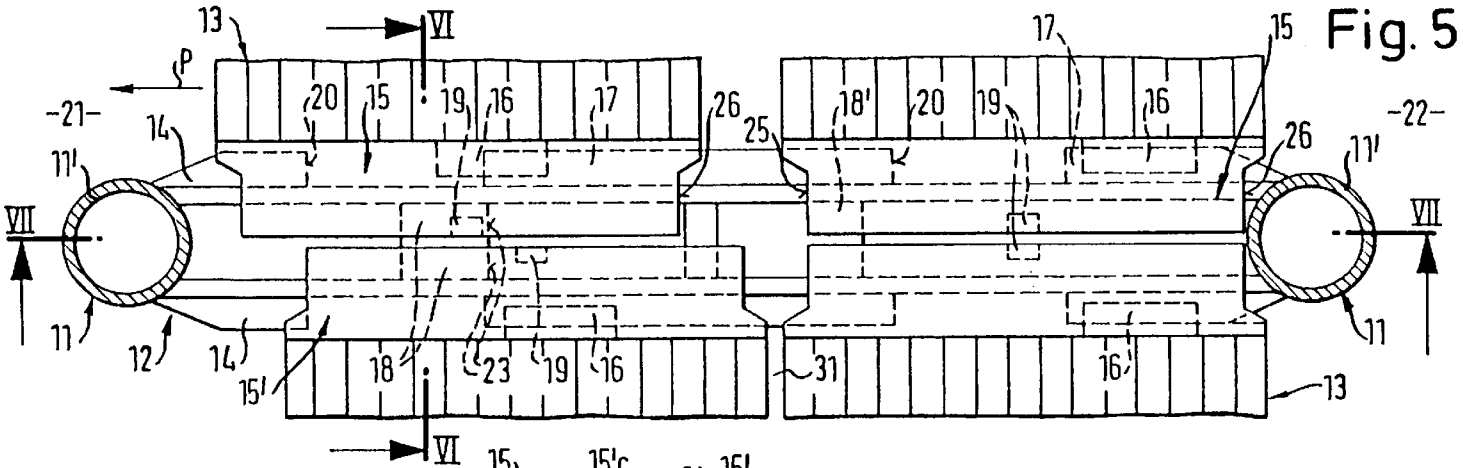
FIG. 5 is a partial plan view analogous to FIG. 2 during the removal or installation of a floor panel.
Figure 6:
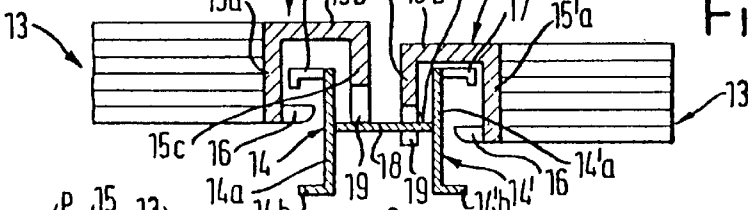
FIG. 6 is a schematic side view in accordance with the line VI—VI in FIG. 5.
Figure 7:
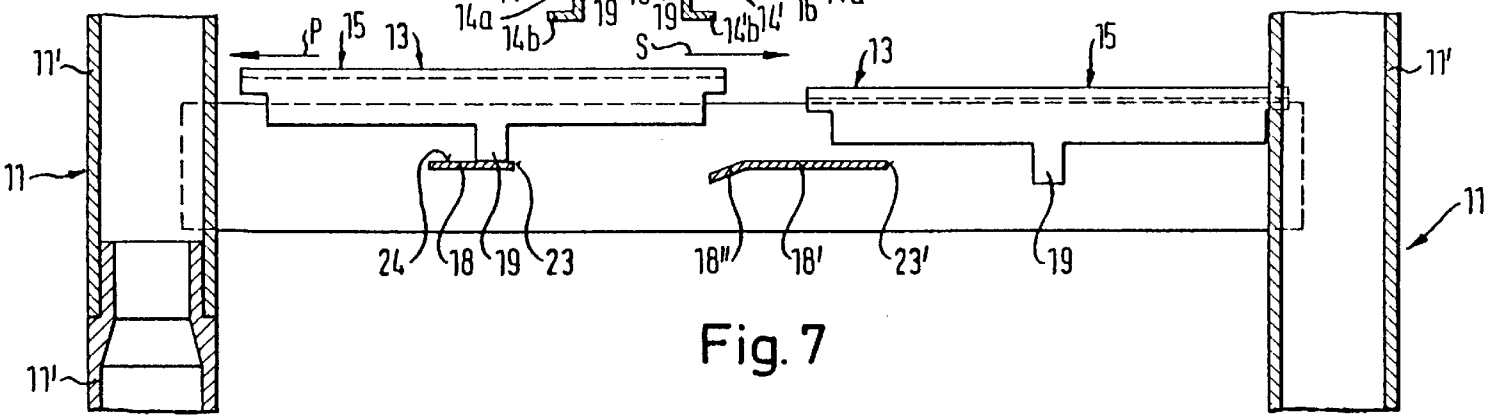
FIG. 7 is a schematic side view in accordance with the line VII—VII in FIG. 5.

In accordance with FIGS. 2 to 4 the transverse struts 12 consist of two rail sections 14, 14' which are mounted spaced apart and parallel to one another on two individual elements 11' located behind one another of vertical supports 11 by welding or by a releasable type of attachment, which have a substantially C-shaped or inverse C-shaped cross-section, and consist of a vertical strip part 14*a*, 14'*a* respectively, a lower, horizontal, short, reinforcing flange 14*b*, 14'*b* respectively, and an upper horizontal flange 17, which can have a greater width than the reinforcing flange 14*b*, 14'*b*. In principle the two rail sections 14, 14' can be connected at the bottom by elongate plates 43, indicated in broken lines in FIG. 3, to form a constructional unit.

The flanges 14*b*, 14'*b* and 17 of the two rail sections 14, 14' extend in opposite directions.

In accordance with FIG. 2 the rail sections 14, 14' are welded at their ends at a spacing K to a vertical support 11 in each case. The mounting could also, for example, be releasable via attachment roses provided on the vertical supports 11.

Between the vertical planar strip parts 14*a*, 14'*a* of the two rail sections 14, 14' there extend, in accordance with FIGS. 3, 4, approximately at half height, at a horizontal spacing, a shifting security abutment plate 18 and a positioning plate 18', which, in accordance with FIG. 4, can extend substantially horizontally, or can rise slightly from the insertion side 21 towards the building side 22. The plates 18, 18' are fixedly connected at both ends to the rail sections 14, 14', for example by welding. Apart from the function of the plates 18, 18' described further below, the transverse struts 12 comprising the rail sections 14, 14' are reinforced in this manner.

In the upper horizontal flanges 17 of the rail sections 14, 14', which extend in opposite directions, cutouts 20 are provided behind one another, with one cutout 20 being located in each case relatively close to the insertion side 21, and one further cutout 20 being located in each case close to the building side 22.

On the narrow ends of the floor panels 13, there are secured end fittings 15, 15', which are of substantially hook-like design in accordance with FIG. 3, and have at the side adjacent the floor panel 13 a vertical strip part 15*a*, 15'*a* respectively, fixedly connected to the latter, a substantially horizontally extending and substantially planar cover part 15*b*, 15'*b* and an outer strip part 15*c*, 15'*c*, such that the end fittings 15, 15' have a substantially inverted U-shaped cross-section.

In order to be able to more simply distinguish the components disposed above one another as illustrated in FIG. 1, the rail sections 14, 14' are provided with hatching extending from the top left to the bottom right, and the end fittings 15, 15' are provided with hatching extending from the top right to the bottom left.

In accordance with the invention, there are provided, at the lower edge of the strip parts 15*a*, 15'*a*, horizontal lifting security projections 16 extending in the direction towards the associated rail section 14, 14' beneath the horizontal flanges 17, and downwardly projecting shifting security abutments 19 at the strip parts 15*c*, 15'*c* lying between the rail sections 14, 14', which cooperate with rear abutment edges 23, 23' of the shifting security abutment plate 18 and the positioning plate 18' respectively.

The vertical spacing G between the lifting security projections 16 and the horizontal flange 17 is greater in the installed state of the floor panel 13, in accordance with the invention, than the vertical degree of overlap between the plates 18, 18' and the shifting security abutments 19.

The surface 24 of the abutment plate 18 serves as a sliding surface for a shifting security abutment 19 lifted onto it.

The abutment plate 18 and the abutments 19 are positioned relative to one another in the horizontal direction such that with abutment of the projection 19 at the rear edge 23 of the abutment plate 18, the lifting security projection 16 of the end fittings 15, 15' is still located beneath the horizontal flange 17, and in any event is still clearly behind the cutout 20, so that on lifting up the end fittings 15, 15' in this state, the projections 19 are admittedly lifted onto the surface 24, but the lifting security projection 16 cannot yet pass upwardly through the cutout 20. This is only possible when the downwardly projecting abutments 19 have been shifted so far on the surface 24 in the direction towards the insertion side 21 that the end fittings 15, 15' come into abutment against the front vertical support 11 in the region of the front cutouts 25. The length of the abutment plate 18 and of the shifting security abutments 19 in the direction of insertion is such that the shifting security abutments 19 lifted onto the surface 24 of the abutment plate 18 slidingly contact the surface 24 until the associated end fitting 15, 15' respectively abuts against the front vertical support 11 on being pulled out toward the front.

In accordance with FIGS. 2 to 4 two identically formed floor panels 13 are mounted behind one another on a respective rail section 14,14'. The rear floor panel 13 abuts in this arrangement in the region of a cutout 26 provided at the rear at the end fittings 15, 15' against the rear vertical support 11. In the center, the two floor panels 13 have at most a small spacing 31 or preferably abut against one another.

As one clearly recognizes from FIGS. 2 and 4, the horizontal spacing H of the shifting security projections 19 of the rear floor panel 13 and of the rear edge 23' of the rear positioning plate 18' is substantially greater than the spacing 35, which is as small as possible, between the shifting security abutment 19 of the front end fitting 15 and the rear edge 23 of the abutment plate 18, which should only lie in the region of the tolerances that are necessary.

In FIG. 2 bores 44 are also indicated in the end region of the rail sections 14, 14', which serve for the insertion of non-illustrated holding pins of the curb strips 36 (FIG. 1). In the region of the rear vertical supports 11, the bores 44 are generally unnecessary, because curb strips 36 are not prescribed at the building construction side. In accordance with the invention, the non-illustrated vertical pins of the curb strips 36, which are inserted into the front bores 44, in particular represent an additional security against shifting of the floor panels 13 to the front. The bores 44 are thus to be correspondingly arranged.

In FIG. 4 it is, furthermore, indicated, at the left, how plug-in spigots 11" provided on the individual elements 11' can be plugged telescopically into an adjoining individual element 11', in order to form a vertical support 11 assembled from numerous individual elements 11'. Further features and details of the invention result from the following functional description, with additional reference to FIGS. 5 to 11.

In accordance with FIGS. 2 to 4 two end fittings 15, 15 and 15', 15' respectively of two floor panels 13 are in each case arranged behind one another on the two rail sections 14, 14', and indeed in such a way that a distance 31 which is as small as possible remains between the floor panels 13 and must be so small that no components or tools can fall downwardly through it. The size of the spacing 31 is determined by the tolerances which are necessary in the assembly of such a scaffold.

At the building side 22 the end fittings 15, 15' located there abut in the region of the cutout 26 against the rear vertical support 11, whereby the depth of insertion of the two floor panels 13 arranged behind one another is determined. The shifting security abutment 19 of the end fittings 15, 15' disposed towards the insertion side 21 in each case engages behind the rear edge 23 of the shifting security plate 18, and indeed while leaving the minor spacing 35 which should be as small as possible and is determined by the usual tolerances with such scaffolds. In this manner two floor panels 13 lying behind one another are in each case also secured against sliding towards the insertion side 21.

Should now wind forces, for example acting from the bottom on the floor panels 13, attempt to lift these from the rail sections 14, 14', then this is prevented by the lifting security projections 16, which engage beneath the horizontal flange 17. The same applies if any form of tilting moments occur about the longitudinal axis of the floor panels 13, for example by treading on the front or rear marginal region of the floor panels 13 which project beyond the region of support on the rail sections 14, 14'.

If the floor panels 13 are to be lifted from the rail sections 14, 14', then the curb strips 36 are first removed from the securing bores 44. Thereafter, one of the front floor panels 13 is first lifted in accordance with FIGS. 5 and 7 sufficiently far that the downwardly projecting shifting security abutment 19 is lifted to the level of the surface 24 of the shifting security abutment plate 18, and the floor panel 13 is then shifted in the direction of the arrow P towards the insertion side 21, with the abutment 19 being able to slide on the surface 24. Through the lifting of the shifting security abutment 19 to the level of the surface 24, the sliding prevention lock formed by the shifting security abutment plate 18 and the shifting security abutment 19 is cancelled. The relevant floor panel 13 can then be shifted in the direction of the arrow P sufficiently far until the edge of the front cutout 25 abuts against the rear side of the front vertical support 11, in which position the projection 16 is vertically aligned with the cutout 20 in the horizontal flange 17, whereupon the end fittings 15 and 15' respectively can be lifted upwardly without problem from the associated rail section 14. In order to release the front floor panel 13, a wholly conscious movement of the floor panel 13 first vertically upwardly and then forwardly is necessary, such as cannot be randomly produced, for example by wind forces, so that as a result of the measure of the invention, an extensive security of the front floor panels 13 against chance lifting is given, and, on the other hand, a problem-free conscious removal is also possible.

Figure 8:
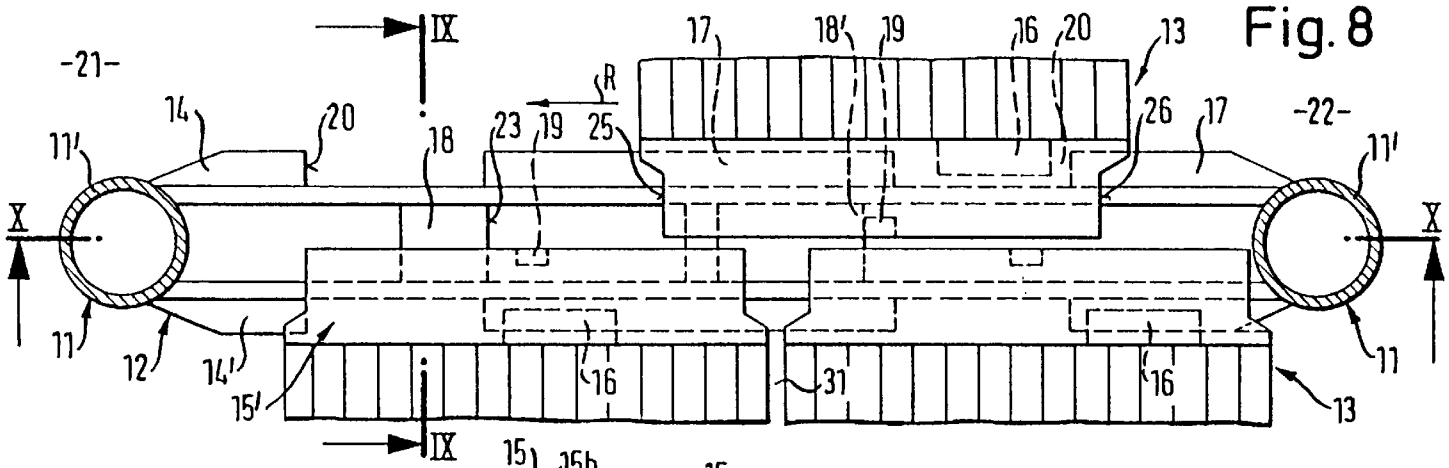
FIG. 8 is a partial plan view analogous to FIGS. 2 and 5, with the front floor panel completely removed and in the stage of removal of a rear floor panel.
Figure 9:
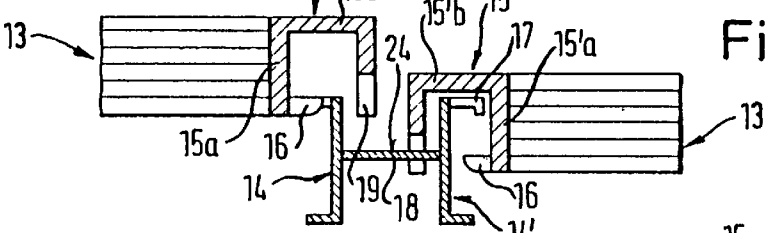
FIG. 9 is a schematic sectioned view in accordance with the line IX—IX in FIG. 8.
Figure 10:
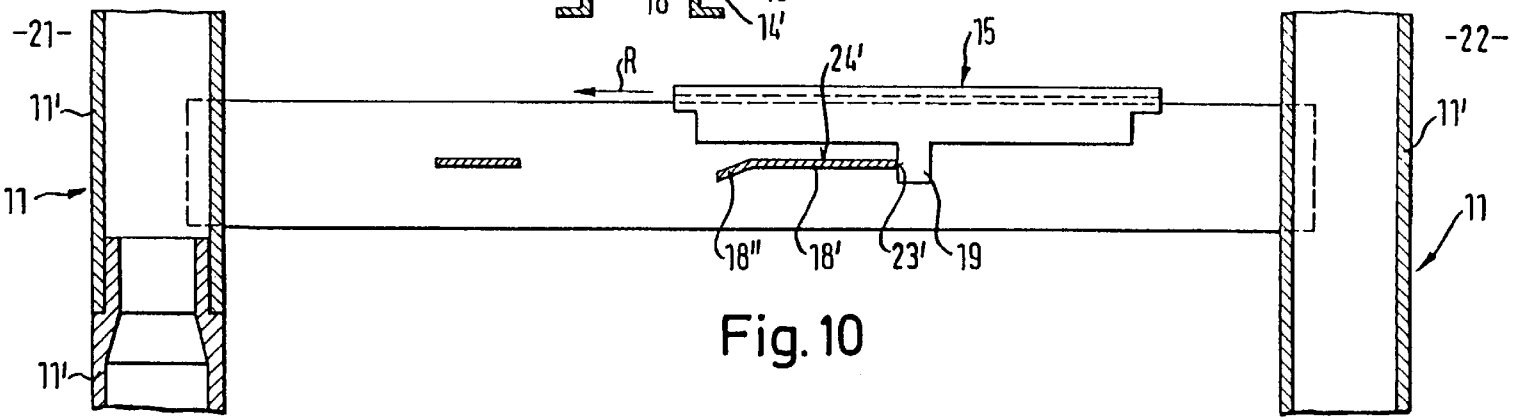
FIG. 10 is a schematic sectioned view in accordance with the line X—X in FIG. 8.

After the one of the two front floor panels 13 has been removed in accordance with FIGS. 8 to 10, the rear floor panel 13, which is now no longer restricted at the front by another floor panel 13, can likewise be shifted forwardly in the direction of the insertion side 21, until the shifting security abutment 19 provided at its end fitting 15, 15' abuts against the rear edge 23' of the rear positioning plate 18' (FIG. 10). Now, in contrast to the relationships for the front floor panels 13, the lifting security projections 16 and the cutouts 20 in the horizontal flanges 17 are vertically aligned with one another, so that in accordance with FIG. 9 the end fitting 15 can be lifted from the associated rail section 14. At the rear floor panels 13, the shifting security abutments 19 and the positioning plate 18' thus simply serve as an indicator through which the operator is made aware by the abutment of the two components 18', 19 against one another that the floor panel 13 is now ready for the lifting from the rail section 14.

After the shifting security abutment 19 has been lifted beyond the level of the surface 24' of the positioning plate 18', the rear floor panel 13 can now be pulled out forwardly in the direction of the arrow R, with the shifting security abutment 19 being able to slide on the surface 24' if necessary.

The mounting of the floor panels on the rail sections 14, 14' takes place in the reverse sequence as follows:

First of all the rear floor panel 13 is mounted from the insertion side 21 in such a manner that the shifting security abutment 19 is placed onto the rear positioning plate 18', and the floor panel 15 is shifted with the end fittings 15, 15' towards the building side 22, with the shifting security abutment 19 sliding rearwardly on the surface 24' of the positioning plate 18' until it finally reaches behind the end edge 23', whereupon the end fitting drops downwardly until it contacts the horizontal flange 17 over its full length. During this the lifting security projection 16 moves through the cutout 20 below the level of the horizontal flange 17, whereupon the floor panel 13 with the end fitting 15 is shifted rearwardly into the position evident in FIGS. 5 to 7, until the end fitting 15 comes into contact against the rear vertical support 11 in the region of the cutout 26. The rear floor panel 13 is now located in its desired position.

In order to facilitate the sliding of the shifting security abutment 19 on the positioning plate 18', this can either itself be formed as a rearwardly rising ramp or can have such a run-up ramp 18" at its end adjacent the insertion side 21. In this manner the shifting security abutment 19 can enter into sliding engagement with the surface of the ramp 18" solely by pushing the floor panel 13 rearwardly, without the floor panel 13 having to be lifted on being pushed into place, so that the end fitting 15 is lifted on further shifting of the floor panel towards the building side 22, until finally the shifting security abutment 19 reaches behind the end edge 23' of the positioning plate 18', and the end fitting 15 drops downwardly in the above-described manner, whereupon the cover parts 15*b*, 15'*b* lie on the flange 17, as can, for example, be recognized in FIG. 3. Thereafter, the shifting of the end fittings 15, 15' into the desired position evident from FIGS. 2 to 7 then takes place again.

Now the front floor panel 13 is also mounted as follows:

The front floor panel 13 is first placed onto the associated rail section 14 in such a way that the end fitting 15 abuts from the rear against the front vertical supports 11 in the region of the front cutouts 25. In this position the lifting security projection 16 and the cutouts 20 and the horizontal flanges 17 are vertically aligned with one another so that the end fitting 15 can move sufficiently far downwardly for the shifting security abutments 19 to come into contact on the surface of the shifting security abutment plates 18. As a result of the dimensioning in accordance with the invention the lifting security projection 16 now come to lie lower than the horizontal flanges 17, so that on shifting the floor panel 13 in the direction of the arrow S in FIG. 7, the lifting security projections 16 already engage beneath the horizontal flanges 17 before the shifting security abutment 19 sliding on the surface 24 finally reaches behind the rear edge 23 of the shifting security abutment plate 18, whereupon the floor panel 13 with the end fittings 15, 15' drops downwardly into its desired position shown in FIGS. 2 to 4, where the cover parts 15*b*, 15'*b* of the end fittings 15 lie throughout on the horizontal flanges 17.

The shifting security abutments 19 should be arranged in the region of the center of the end fittings 15, 15', so that when the shifting security abutments 19 lie on the shifting security abutment plates 18, 18', the floor panel 13 adopts an unstable position in which it tilts about its longitudinal axis during handling, which is an indication for the operator that the floor panel 13 is not yet located in its end position. A stable, no longer tilting position is first achieved when the shifting security abutments 19 have slid off from the shifting security plates 18 at the rear.

Figure 11:
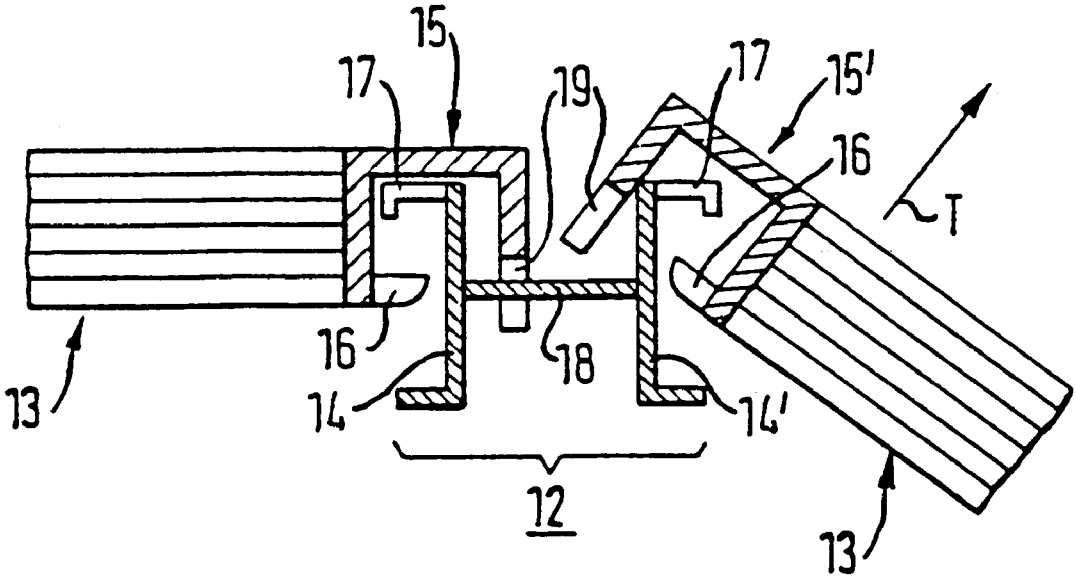
FIG. 11 is a sectional view analogous to FIG. 3, but with one of the two illustrated floor panels being pivoted downwardly about the associated rail section.

In accordance with FIG. 11 the rail sections 14, 14' and also the end fittings 15, 15', with their various projections and cutouts, should be so dimensioned that a tilting of each floor panel 13 downwardly is also possible out of the position secured against lifting, and indeed in such a way that, for example, on pivoting of the floor panel 13 downwardly about the rail section 14', a lifting in the direction of the arrow T in FIG. 11 is possible without previous horizontal shifting of the floor panel 13. In the reverse sequence each floor panel 13 can thus also be mounted in an oblique position on the rail sections 14, 14'; however, a lifting out in the above-indicated sense must first take place at the opposite side. As soon as the end of the floor panel 13 has been lifted there from its associated rail section 14, 14', the end frame 32 located there with the vertical supports 11 and transverse struts 12 can be resiliently pushed away from the floor panel 13 somewhat, whereupon a tilting of the floor panel 13 downwardly in accordance with FIG. 11 is possible. On the mounting of a floor panel 13 in the tilted state in accordance with FIG. 11, the other end must subsequently be lifted above the level of the rail section there, with the end frame 32 resiliently pushed away, and subsequently mounted on the rail section in the above-described sense.

It is thus particularly advantageous that on tilting of a floor panel 13 downwardly in accordance with FIG. 11, none of the parts moved relative to one another come into engagement with one another in such a manner that they could be damaged or destroyed.

As a result of the design in accordance with the invention, each front floor panel 13 can be removed and installed independently of the remaining floor panels 13. In order to remove one of the rear floor panels 13, it is only necessary to first push the floor panel 13 lying in front of it forwardly, and indeed until the frontmost one abuts against the front vertical support 11.

The insertion of the floor panels 13 is in particular facilitated by the design of the invention and made safer, because the operator receives a feeling both for the non-latched and also for the latched position of each floor panel 13.

Since the safety curb holding bores 44 are located, in accordance with the invention, relatively close to the front and rear edges of the floor panels 13, i.e. of the end fittings 15, 15', a further indication for a problem-free positioning of the mounted floor panels 13 can be seen in the fact that the safety curb retaining bores 44 are exposed for the reception of the holding pins of the curb strips 36. By inserting the vertical spigots of the curb strips into the bores 44, the floor panels 13 are additionally secured against shifting to the front.

The shifting security abutments 19 have the further advantage that when a floor panel 13 lies with its lower side obliquely (FIG. 11) on a rail section 14, 14', and is then shifted in its longitudinal direction up to vertical alignment of the upper end fitting 15, 15' with the associated rail section 14, 14', the downwardly projecting shifting security abutment 19 first engages behind the associated rail section 14, 14', and thus the longitudinal shifting is terminated at the instant where the end fitting 15, 15' is located in the relative position required for a holding engagement with the associated rail section 14, 14'.

What is claimed is:

1. A scaffold which can be dismantled comprising at least four vertical supports arranged at corners of a rectangular base area which form a rear side and a front side of the scaffold; at least two substantially parallel, horizontal struts extending from the front side to the rear side and connecting first and second, spaced-apart pairs of the vertical supports, each strut including at least one substantially horizontal rail section secured to the supports; at least one floor panel supported by the struts, each floor panel terminating in hook-like end fittings engaging associated rail sections of the struts, being placed on the scaffold by moving it in an insertion direction from the front side toward the rear side of the scaffold, and defining an upper floor panel surface; a first security arrangement for each floor panel cooperating with the rail sections, preventing a lifting of the floor panel when engaged and permitting a lifting of the floor panel when disengaged, the first security arrangement comprising an abutment means on at least one of said hook-like end fittings and on an associated rail section being engageable and disengageable by moving the end fittings, and therewith the floor panel, in a longitudinal direction of the at least one rail section; and a second security arrangement for each floor panel cooperating with the rail sections which prevents a horizontal shifting of the floor panel when engaged and permits a horizontal shifting of the floor panel when disengaged, the second security arrangement comprising a second abutment means on said at least one of said hook-like end fittings and on said associated rail section, said second abutment means being disengageable by lifting said at least one end fitting relative to the associated rail sections and, when engaged, securing the end fitting in a position preventing shifting of the first security arrangement from an engaged position to a disengaged position, the first and second security arrangements being disposed at the rail sections and the associated end fittings, respectively, and below the upper surface of the end fittings.

2. A scaffold according to claim 1 wherein at least some struts comprise first and second, horizontally spaced-apart rail sections.

3. A scaffold according to claim 1 wherein portions of the upper surface defined by the end fittings and a remainder of the floor panel are flush with one another.

4. A scaffold according to claim 2 wherein abutment means includes substantially horizontally oriented lifting security projections, respectively carried by the end fittings and the rail sections, and arranged so that they at least partly overlap when the first security arrangement is engaged to thereby limit a lifting of the end fittings relative to the associated rail sections, the lifting security projections being movable to eliminate the overlap between them by lifting the end fittings and shifting them opposite to the insertion direction.

5. A scaffold according to claim 4 wherein the second abutment means includes abutments respectively carried by the rail sections and end fittings which become engaged by moving the abutments relative to each other opposite to the insertion direction, the abutments being configured so that they become engage before the first security arrangement becomes disengaged due to a shifting of the first security arrangement, the second security arrangement being further configured to permit a lifting of the end fittings relative to the rail sections and, thereafter, a further shifting of the abutments opposite to the insertion direction until the first security arrangement is disengaged.

6. A scaffold according to claim 1 wherein the vertical supports at the rear side of the scaffold form abutments limiting movement of the floor panels in the insertion direction.

7. A scaffold according to claim 4 wherein the lifting security projections comprise a horizontal flange defined by each rail section, the horizontal flange including a cutout, and a lifting security member attached to each end fitting and arranged beneath the horizontal flange so that the lifting security member can be moved through the cutout by shifting the end fittings along the rail sections.

8. A scaffold according to claim 7 wherein the horizontal flanges of the rail sections are located at tops of the rail sections.

9. A scaffold according to claim 7 wherein the second abutment means includes shifting security abutments carried by the rail sections and the end fittings, and wherein at least one of the lifting security members and the shifting security abutments is located at about a longitudinal center of the end fittings as seen in the insertion direction.

10. A scaffold according to claim 5 wherein the shifting security abutments extend between the rail sections of the transverse strut.

11. A scaffold according to claim 5 wherein the shifting security abutments comprise a substantially horizontally positioned abutment plate including an edge facing in the insertion direction which forms an abutment for another one of the shifting security abutments, the abutment plate including a surface slidably engaging the other one of the shifting security abutments when the end fittings are lifted relative to the rail sections and moved opposite to the insertion direction over a distance sufficient to place the first security arrangement in its disengaged position.

12. A scaffold according to claim 5 and including means associated with each floor panel located proximate the front side of the scaffold which, following the disengagement of the second security arrangement, prevents a pull-out movement of the floor panel beyond a position in which the first security arrangement becomes disengaged.

13. A scaffold according to claim 12 wherein the means preventing the pull-out movement of the floor panel is formed by vertical supports at the front side of the scaffold.

14. A scaffold according to claim 7 wherein a vertical spacing between the lifting security member of the end fittings and the horizontal flange of the rail sections is greater than a vertical overlap between a shifting security abutment of the rail sections and the shifting security abutment of the end fittings.

15. A scaffold according to claim 1 wherein the first security arrangement is located on a side of the rail sections facing towards the floor panel and the second security arrangement is located on a side of the rail sections facing away from the floor panel.

16. A scaffold according to claim 1 including at least two floor panels arranged on the horizontal struts one behind the other in the insertion direction.

17. A scaffold according to claim 16 wherein the at least two floor panels adjoin each other.

18. A scaffold according to claim 16 wherein the second abutment means comprises a substantially horizontal positioning plate carried by the rail sections and a shifting security member carried by the floor panel and which, when the floor panel is in its installed position, vertically overlaps the positioning plate and has a horizontal spacing from the positioning plate which is selected so that upon moving the floor panel opposite the insertion direction the shifting security member first engages the positioning plate after the first security arrangement has been disengaged.

19. A scaffold according to claim 11 wherein the other one of the shifting security abutments is located proximate a longitudinal center of the end fittings so that, when the other one of the shifting security abutments is supported by the abutment plate the floor panel adopts an unstable position and can be tilted about an axis which connects the other ones of the shifting security abutments located at opposite ends of the floor panel.

20. A scaffold according to claim 1 wherein ends of the end fittings facing vertical supports include cutouts which abut and partially surround the vertical supports.

21. A scaffold according to claim 20 including at least front and rear parallel floor panels supported by each rail section, wherein opposing end fittings of adjacent floor panels define a cutout between them, and wherein a positioning plate for the rear floor panel is located beneath the cutout.

22. A scaffold according to claim 1 wherein the end fittings, the first security arrangement, and the second security arrangement are configured so that each floor panel can be pivoted downwardly from its horizontal position about an axis extending approximately along the associated rail section so that each floor panel is readily lifted from the associated rail section even when the panel is in a position in which it is secured against lifting.

23. A scaffold according to claim 1 wherein each end fitting extends over the full width of the associated floor panel as seen in the insertion direction, and the full lengths of the fittings overlie the associated rail section.

24. A scaffold according to claim 19 wherein the lifting security projections comprise a horizontal flange defined by each rail section, the horizontal flange including a cutout, wherein each floor panel has a longitudinal center line extending substantially perpendicular to the rail sections, and wherein the abutment plate, the positioning plate associated with the rail sections, and the cutout in the horizontal flange, respectively, are located, when the floor panels are in their fully inserted positions, on a side of the respective center lines facing away from the insertion direction.

25. A scaffold according to claim 4 wherein each end fitting includes a strip part which extends downwardly from the top surface and ends in lower strip edges, and wherein the shifting security abutment extends below the lower strip edges.

* * * * *